US005755083A

United States Patent [19]

Cleine

[11] Patent Number: 5,755,083

[45] Date of Patent: May 26, 1998

[54] WRAPPING APPARATUS WITH SHUTTLE CHANGE

[75] Inventor: Kenneth David Cleine, Dromana, Australia

[73] Assignees: BHP Steel, (JLA) Pty. Ltd., Melbourne; K.C. Metal Products Pty. Ltd., Dromana, both of Australia

[21] Appl. No.: 687,443

[22] PCT Filed: Feb. 14, 1995

[86] PCT No.: PCT/AU95/00070

§ 371 Date: Oct. 3, 1996

§ 102(e) Date: Oct. 3, 1996

[87] PCT Pub. No.: WO95/21769

PCT Pub. Date: Aug. 17, 1995

[30] Foreign Application Priority Data

Feb. 14, 1994 [AU] Australia ..... PM3881

[51] Int. Cl.[6] ..... B65B 25/24; B65B 27/06; B65B 13/02

[52] U.S. Cl. ..... 53/588; 53/399; 53/204; 53/409

[58] Field of Search ..... 100/12, 27; 53/399, 53/409, 204, 588, 589, 389.1, 167

[56] References Cited

U.S. PATENT DOCUMENTS

| | | | |
|---|---|---|---|
| 3,320,874 | 5/1967 | Gasper et al. | 53/589 X |
| 4,509,415 | 4/1985 | Stobb | 53/589 X |
| 4,625,635 | 12/1986 | Lewis | 53/589 X |
| 5,282,347 | 2/1994 | Cleine et al. | 53/588 X |

FOREIGN PATENT DOCUMENTS

| | | | |
|---|---|---|---|
| 3024872 | 1/1982 | Germany | 53/204 |
| 797961 | 1/1981 | U.S.S.R. | 53/204 |
| 1465347 | 3/1989 | U.S.S.R. | 53/204 |

*Primary Examiner*—Linda Johnson

*Attorney, Agent, or Firm*—Nikaido, Marmelstein, Murray & Oram LLP

[57] ABSTRACT

In a wrapping apparatus comprising a two-part endless track surrounding a wrapping station, a shuttle for dispensing wrapping medium able to ride around the track and thereby wrap an article in said station, and a track support structure such that at least one part of the track may be moved relative to another part so as to open and close a gap between those parts, a shuttle change may be effected by providing a movable shuttle carrier in the form of a length of track, and means enabling the shuttle carrier to be inserted into and removed from a gap in the track whereby a replacement shuttle may be driven from the carrier onto the track and a spent shuttle may be driven from the track onto the carrier for removal therewith.

20 Claims, 8 Drawing Sheets

WRAPPING APPARATUS WITH SHUTTLE CHANGE

TECHNICAL FIELD

This invention relates to wrapping apparatus of the kind comprising a dispensing shuttle, from which a web of wrapping medium is drawn, and which rides around an endless track and thereby orbits an article, or part of an article, that is to be wrapped.

BACKGROUND ART

In some instances the track of such wrapping apparatus is linked with an annular or similar article to be wrapped. In such instances, the track necessarily comprises two parts that may be separated, to enable the track to be linked with the article, and then re-united to enable wrapping to proceed. One of the track parts may be hinged to the other, but, for preference, the two parts of the track have been separable bodily, to create two gaps in the track when they are separated.

In that an element of the present invention is the creation of a gap in the track, it is particularly well adapted for application to wrapping apparatus able to link with annular articles as aforesaid.

An example of wrapping apparatus of the kind under discussion, as used, for example, to wrap coils of metal strip in plastics film or sheet, is disclosed in the specification of our Australian patent No. 653,255. From that specification it will be apparent that the wrapping medium, having been drawn as a web from a roll of medium carried by the shuttle, follows a tortuous path within the shuttle to enable it to be tensioned and to provide a reserve of tensioned web for accommodating variations in the rate at which the web is drawn from the shuttle.

As a result, re-loading a shuttle when all of the roll of medium is spent, or re-threading the web through the shuttle in the event of the web breaking, are time consuming operations, so that there is considerable down time of the apparatus due to such operations. This is particularly unsatisfactory if the wrapping apparatus is operating as part of a production line that dictates the time available for the completion of each wrapping operation.

DISCLOSURE OF INVENTION

An object of the present invention is to reduce the down time inherent in the process of re-loading or re-threading a shuttle.

The invention consists in wrapping apparatus comprising a multi-part endless track surrounding a wrapping station, a shuttle for dispensing wrapping medium able to ride around the track and thereby wrap an article in said station, a track support structure operable to move at least one part of the track relative to another part so as to open and close at least one gap between those parts, a shuttle carrier adapted, at least when said at least one gap is less than fully open, to span said at least one gap as a continuation of the track thereacross, carrier support means operable to insert and remove said carrier into and from said at least one gap, and control means controlling the operation of the track and carrier support means; whereby a replacement shuttle may be inserted with the carrier and shunted from the carrier onto the track and a used shuttle may be shunted from the track onto the carrier and removed with the carrier.

The invention further comprises a method of reloading a wrapping apparatus of the kind comprising an endless track and a shuttle for dispensing wrapping medium able to ride around said track, comprising the steps of providing a loaded shuttle on a shuttle carrier, creating a gap in said track, inserting said shuttle carrier into said gap, shunting a spent or partly spent shuttle from said track onto said carrier, shunting said loaded shuttle from said carrier onto said track, removing said carrier from said gap, and closing said gap.

BRIEF DESCRIPTION OF THE DRAWINGS

By way of example, a presently preferred embodiment of the above described invention is described in more detail hereinafter with reference to the accompanying drawings.

BEST MODE OF CARRYING OUT THE INVENTION

Figure 2:
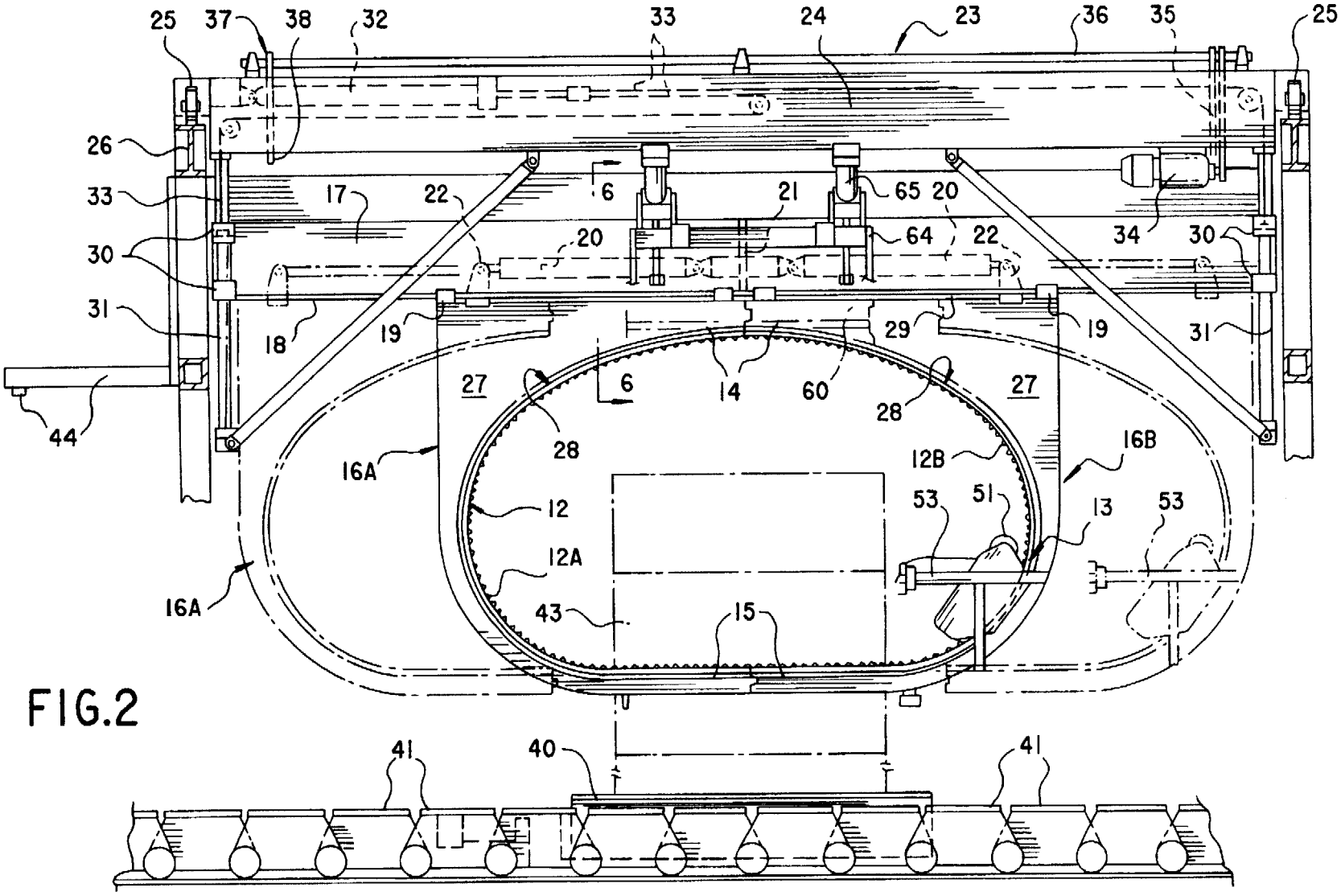
FIG. 2 is a sectional side elevation of the apparatus of FIG. 1 taken on line 2—2 of that figure, with movable track parts shown in full line in a "track closed" position and in broken line in a "track open" position.
Figure 3:
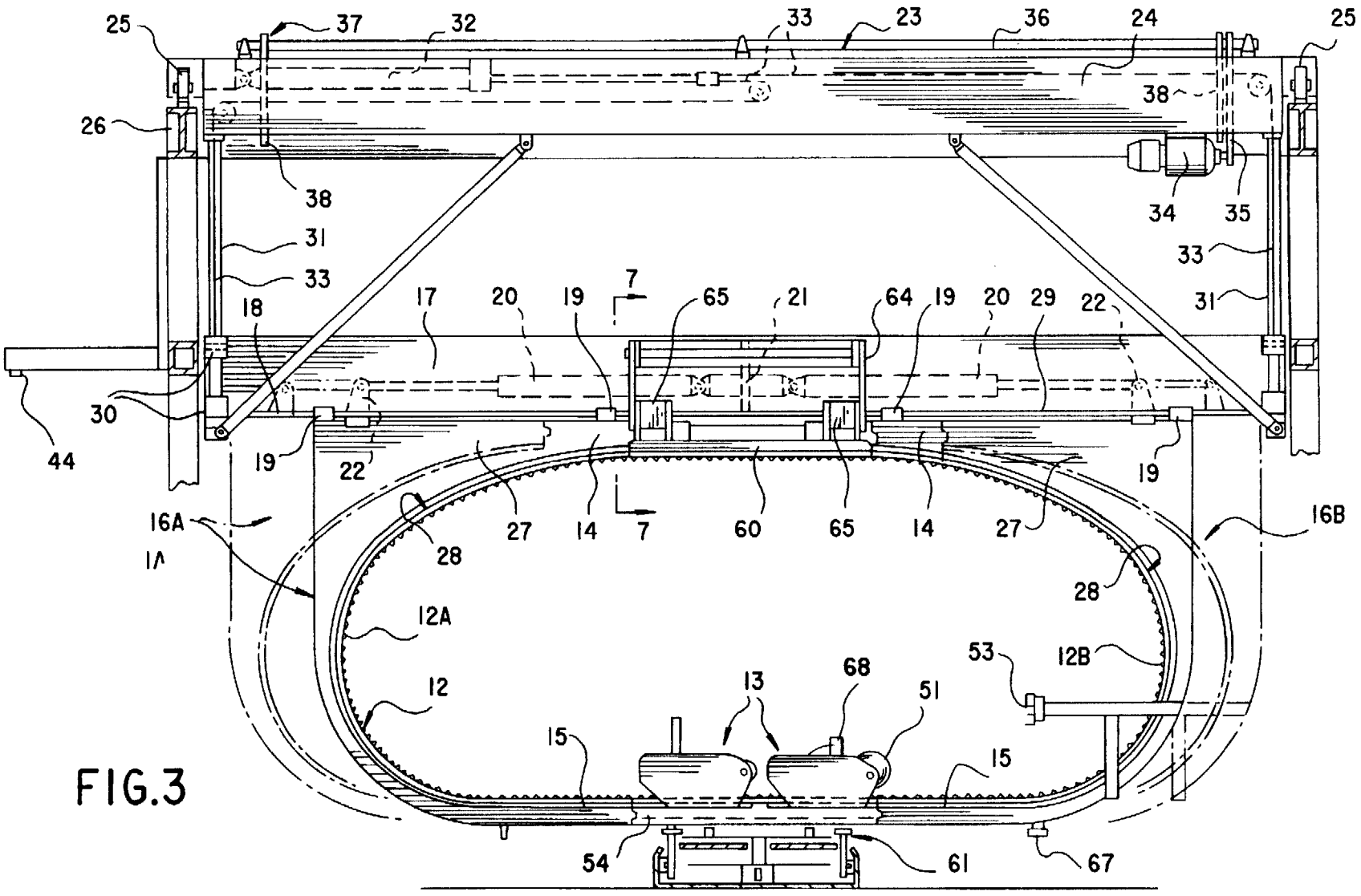
FIG. 3 is a view similar to FIG. 2 taken on line 3—3 of FIG. 1.

According to the preferred embodiment described in the specification of our above mentioned Australian patent the movable track part was hinged to the other part, but in the exemplary embodiment of the invention now being described, a shuffle track 12 being the rail or like component directly engaged by a dispensing shuttle 13 and which determines the path of the shuttle, comprises two bodily separable track parts 12A and 12B respectively, each of which is a mirror image of the other. The track parts 12A and 12B are generally U shaped, each comprising an upper limb 14, a lower limb 15 and smoothly curved crotch portions connecting the limbs together. The upper limbs 14 are in alignment and project towards each other. The same applies to the lower limbs 15. This enables a normal wrapping operation to proceed while the track 12 is in the "track closed" position wherein the free ends of the U-limbs of one part of the track abut those of the other, to form a continuous loop, as shown in full line in FIG. 2.

For preference, the track parts 12A and 12B are disposed so that the common plane in which all four limbs lie is a vertical plane.

The shuttle track 12 is supported or defined by a rigid track support structure. In the present instance the track support structure is also formed as two separate parts 16A and 16B. The parts 16A and 16B of the track support structure depend from an overhead beam 17 and are secured thereto in a manner permitting each of them to be moved to and fro along the beam into "track open" and "track closed" positions respectively.

In the present instance the beam 17 is a hollow box section with projecting flanges 18 extending along its bottom corners, and those flanges are engaged by C sectioned slides 19 fixed to the parts 16A and 16B of the track support structure. The parts 16A and 16B of the track support structure may be moved along the beam 17 by any appropriate motor means or linear actuator, in the present instance the aforesaid movement is effected by double acting hydraulic cylinders 20 mounted within the beam 17. Those cylinders 20 are connected at their adjacent ends to a central anchorage 21 and at their opposite ends to brackets 22 extending from the respective track support structure parts 16A and 16B through slots in the lower wall of the beam 17. For preference the brackets 22 are respectively connected to opposite flights of an endless loop of chain (not shown) trained around sprockets at each end of the beam 17, so as to ensure that as the track support structure parts 16A and 16B move to and fro they always remain equidistant from the centre point of the beam 17.

Thus, both track parts 12A and 12B are movable to and fro so as to open and close gaps between the free ends of their upper limbs 14 and their lower limbs 15, but it will be appreciated that in other embodiments one part may be stationary, so that movement of the track parts between the "track open" and "track closed" positions is then effected by movement of one part only.

Figure 1:
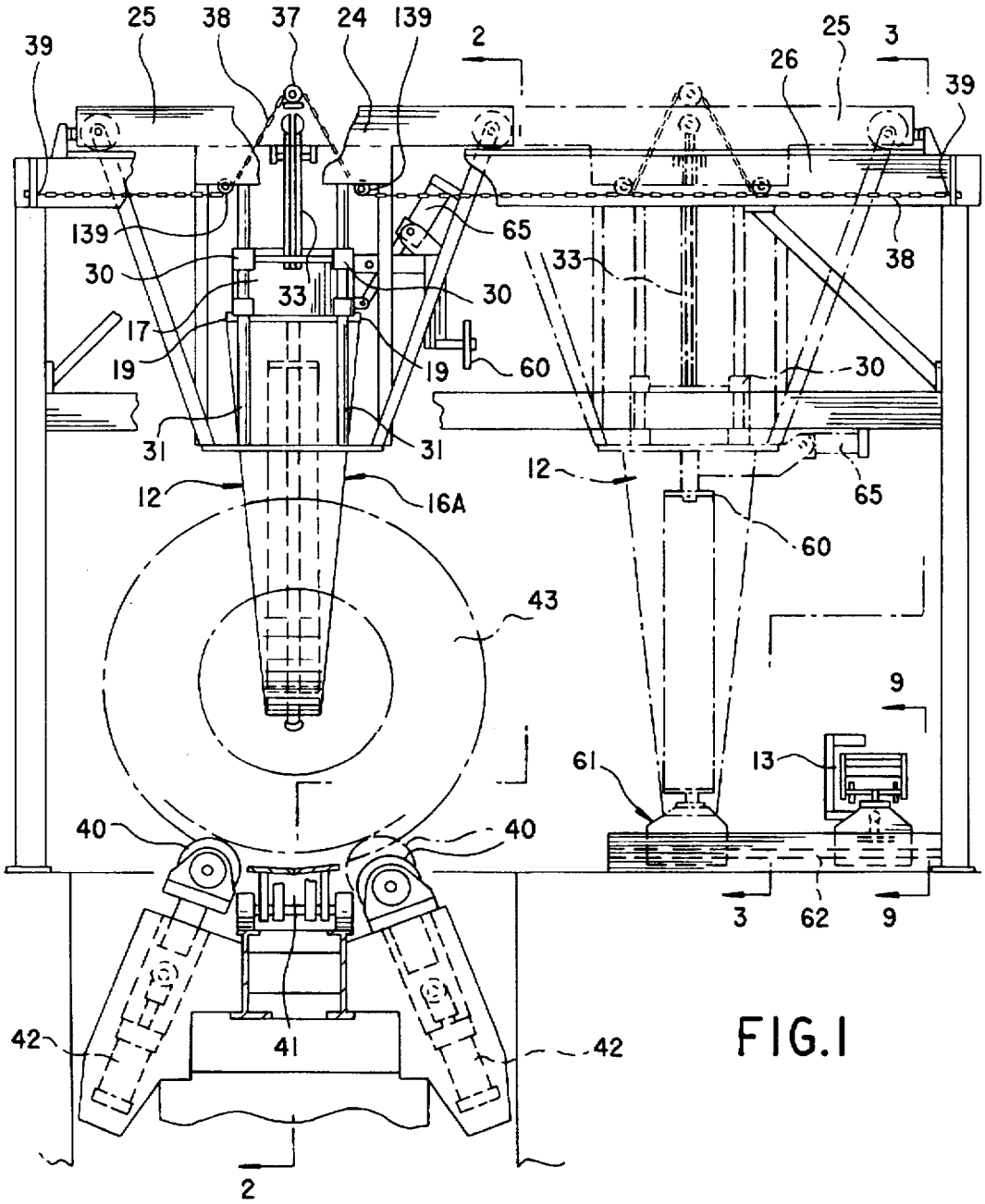
FIG. 1 is and end elevation of a wrapping apparatus according to the invention with some parts cut away and other movable parts shown in full line in an "on-line" position as during a wrapping operation and in broken line in an "off-line" position as during a shuttle change operation.

For preference the overhead beam 17, and therefore the track support structure as a whole, is movable laterally, that is to say in the horizontal direction perpendicular to the length dimension of the beam 17, between "on-line" and "off-line" positions, as may best be seen from FIG. 1. To that end the beam 17 itself may be supported below lateral traversing means, comprising in this instance a fabricated bridge structure 23, similar to that of a conventional workshop travelling crane, comprising a girder 24 extending between bogies 25, adapted to drive, or be driven, along elevated rails 26 extending along opposite sides of a personnel exclusion zone within which wrapping takes place.

The bogies 25 may be driven as aforesaid by any conventional motorised drive means or linear actuator. In the present instance the lateral traverse drive means comprise a reversible gear motor 34 connected by a transmission chain 35 mounted upon the girder 24. The shaft 36 has sprockets 37 engaged with a chains 38 extending tightly from respective end anchorages 39 near each end of the rails 26. The chains 38 extend about guide sprockets 139 on the bogies 25. The chains 38 thus function as stationary racks and rotation of the motor 34 causes the bogies 25 to traverse the rails 26.

Figure 4:
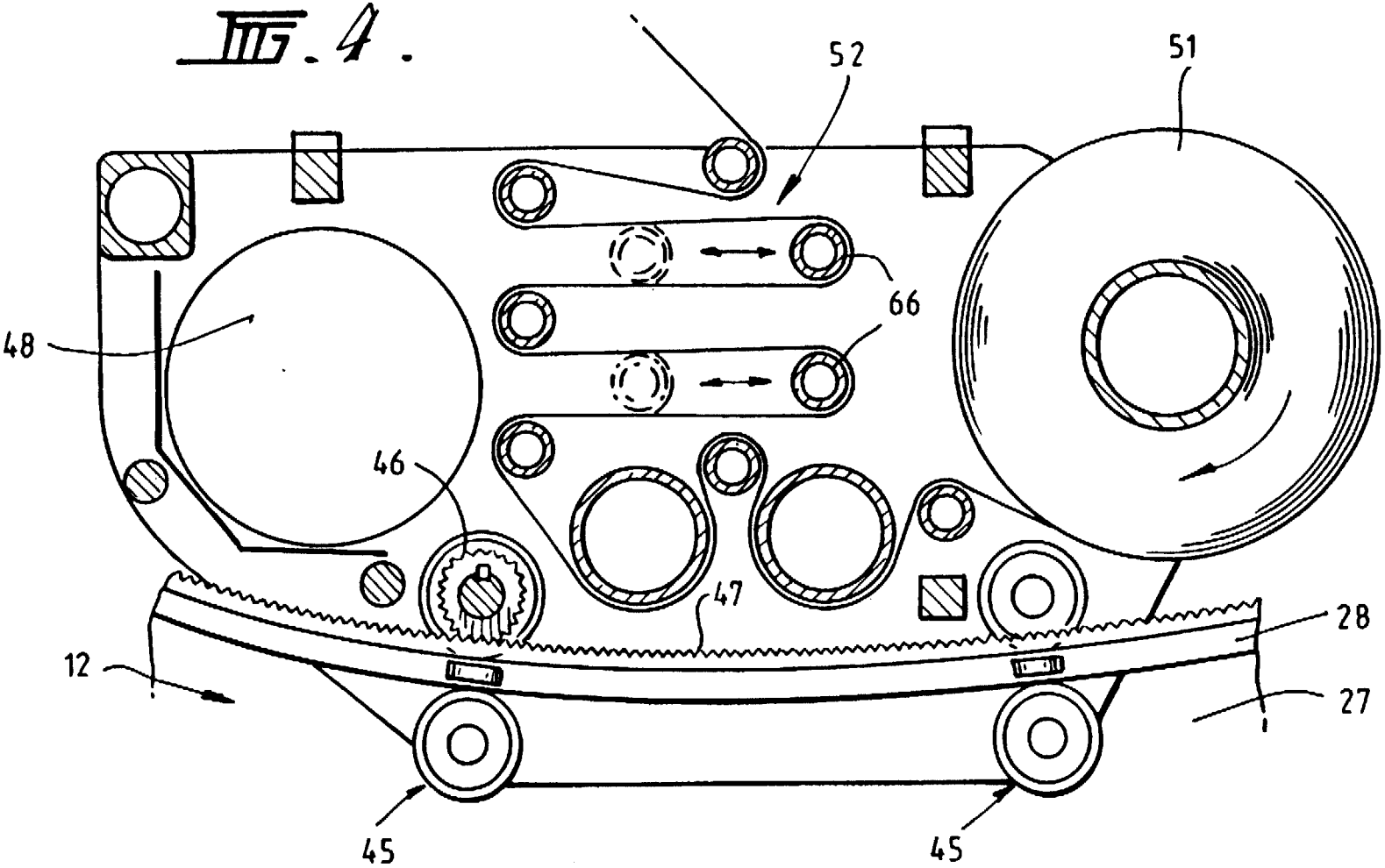
FIG. 4 is a longitudinal sectional elevation of a loaded shuttle, being a component of the apparatus of FIG. 1 drawn to a larger scale.
Figure 5:
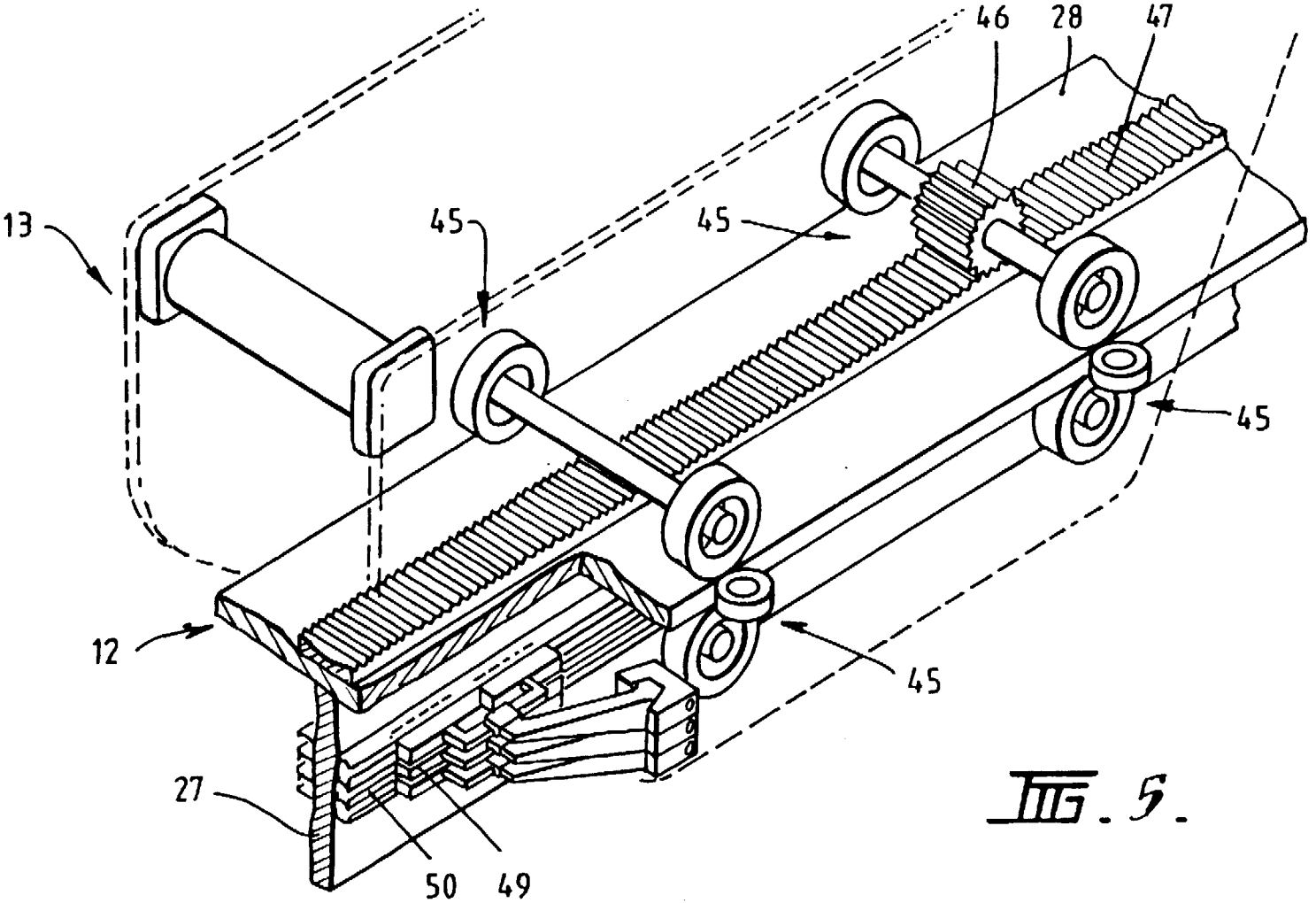
FIG. 5 is a diagrammatic cut away perspective view of the shuttle of FIG. 4 showing its engagement with a track and power supply means.

Each of the track supporting structure parts 16A and 16B comprises a vertical plate 27 having a profiled edge conforming with that part of the path of the shuttle defined by the part. That profiled edge may have a relatively narrow edge flange 28 (see FIGS. 4 and 5), which together with the adjacent margin of the plate 27 constitutes the part of the T-sectioned track 12 defined by said each structure part. Alternatively, a separable T-sectioned rail may be affixed to the profiled edge of the plate 27.

The remaining edges of the plates 27 may be provided with stiffening edge flanges, including relatively broad top flanges 29 extending along a straight upper edge of the plate.

Those top flanges 29 lie parallel to and closely adjacent the bottom surface of the overhead beam 17. They may carry the slides 19, or they may engage alternative guide means fixed on the beam 17, providing for the mentioned movement of the track structure parts 16A and 16B between the "track open" and "track closed" positions.

The upper limbs 14 have somewhat curved profiled edges, to provide an endless track having an upwardly arched, upper flight, when the track structure parts 16A and 16B are brought together in the "track closed" position, but the lower limbs 15 are preferably straight, and extend as relatively shallow cantilever beams from the respective crotch portions. This provides a relatively long and clear lower flight of that endless track that is adapted to extend through the bore of an annular article and leave clearance for the passage of a shuttle 13 through that bore.

For preference the apparatus comprises elevator means whereby the altitude of the track 12 may be adjusted. In the present instance this may be achieved, for example, by raising and lowering the overhead beam 17 relative to the girder 24. To that end, the ends of the beam 17 may be furnished with cross-head bearings 30 engaging vertical guides 31 near each end of the girder 24, to enable controlled vertical movement under the influence of load bearing linear actuators of one kind or another. In the present instance that movement is effected by an hydraulic cylinder 32 within the girder 24 connected by chains 33 extending over strategically placed sprockets to the ends of the beam 17. The cylinder 32 lifts the beam 17. The weight of the beam and track structure is sufficient to lower it, although, for preference, the hydraulic cylinder is double acting to enable it to control the lowering speed.

The illustrated wrapping apparatus further comprises a workpiece support, preferably comprising two, parallel, horizontal rollers 40, of which at least one is powered, disposed one each side of a heavy duty conveyor comprising, in this instance, an endless train of small carriages 41. The rollers 40 are mounted on hydraulic jacks 42 and may be raised to lift and support a heavy cylindrical workpiece, such as a coil 43 of steel strip or the like, carried by the conveyor into a wrapping station coinciding with the location of the rollers 40. After the article is wrapped the rollers 41 may be lowered to re-seat the article on the conveyor for exit and replacement by the next article to be wrapped. The rollers support and rotate the article as wrapping proceeds. When the article is being brought into or taken away from the wrapping station, the track structure is located in the "off-line" position, as will be more fully described below.

In other embodiments the workpiece support may be in the form of a carriage able to travel transversely of the working portion of track, but, for preference, the workpiece support is stationary and the track is transversely movable as in the illustrated embodiment, wherein the movement of the track relative to the workpiece support (as needed to permit the emplacement and removal of a workpiece and the linking of it with the track), is effected by transverse movement of the bogies 25 and girder 24 along the elevated rails 26 between the "on-line" and "off-line" positions.

Thus, assuming the girder 24 is in the "off-line" position and the track structure parts are in the "track open" position, a coil of metal strip or other article may be positioned for wrapping by placing it upon the conveyor at a point remote from the apparatus, operating the conveyor to bring the coil into the wrapping station, lifting it on the rollers 40, driving the girder 24 into the "on-line" position, if need be, adjusting the altitude of the overhead beam 17 to bring the lower U-limbs 15 of the track parts into alignment with the bore of the article, bringing the track structure parts into the "track closed" position, so that the article then encircles the lower flight of the then endless track 12, activating the shuttle to wrap the article, then after wrapping is completed, shifting the track structure parts 16A and 16B along the overhead beam 17 to their open positions so as to separate the track parts, and driving the girder 24 transversely into the "off-line" position, in readiness for the next operation, and removing the wrapped article.

The adjustment of the altitude of the beam 17 is preferably automatic and to that end a distance measuring transceiver 44 may be positioned above the conveyor to respond to monitor the incoming coil and send an appropriate signal to the control means of the apparatus.

Motorised shuttles 13 are provided, each of which is adapted to ride upon the T-sectioned track. To this end, each shuttle 13 may be provided with four sets of track wheels 45, each set comprising three wheels positioned to contact the side faces and an edge face respectively of the head flange 28 of the T-sectioned track. The shuttle 13 may further comprise a toothed driving wheel 46 engaging a rack 47 extending along flange 28, and a motor 48 and a power transmission for rotation of the driving wheel 46. The shuttle 13 may further comprise wiper contacts 49 adapted to slide upon power supply conductor rails 50 mounted on the web 27 of the T-sectioned track, for energising the shuttle motor 48.

The shuttle 13 carries a roll 51 of wrapping medium, for example, stretch wrap plastics film, and, in preferred instances, conventional tensioning, prestretching, braking and accumulator means 52 for a web of medium drawn from the spool.

The wrapping apparatus may be manually controlled, but for preference, it operates automatically under the control of a programmable logic controller (PLC).

The PLC not only controls the drives to the major mechanical components of the apparatus, but also the operation of the shuttle, via control of the power supply to the conductor rails 50, and ancillary components, such as a web hot wire cutter adjacent a web holder device 53 for gripping the otherwise free end of the web of wrapping medium extending from the shuttle at the commencement of wrapping, and for severing the web when a wrapping operation is finished, and, in the present instance, the operation of the shuttle change equipment that is characteristic of the invention.

The present invention requires track support means such that at least one part of the track is movable relative to another part so as to open and close a gap between those parts for the purpose of shuttle changing. In the present instance this requires no more than appropriate control for that purpose of the positions of the track structure parts 16A and 16B on the overhead beam 17.

Likewise in other wrapping apparatus wherein the track is linkable with the article to be wrapped, it requires no more than control of whatever mechanism that may be provided for separating the track parts to allow linking to be effected.

The invention also requires a shuttle carrier adapted to be inserted into the track as a temporary part thereof. More specifically, in the present instance, the inserted shuttle carrier is positioned between the ends of the lower limbs 15 of the track parts 12A and 12B, so as to become a part of an extended lower flight of the endless track 12.

Thus the preferred shuttle carrier 54 may comprise a short length of T-sectioned track 55, complete with conductor rails 56 and rack 57, similar to that of the main track 12 itself. The carrier 54 may be provided with end formations, and conductor rails with end contacts, the same as those provided at the ends of the limbs 15 of the main track to ensure correct register with the mating part and continuity of power supply from one part to the other.

However the carrier conductor rails 56 are preferably divided into two parts. Those parts are separated or insulated from each other at 58, at or near the mid-length of the carrier. Thus the carrier may be said to have a front end part 54A and a back end part 54B, that are distinguishable one from the other in that the conductor rails 56 of each part are independently energisable.

Also it is preferable for the rack 57 of the carrier to be retractable, so as to enable it to be disengaged from the driving wheel 46 of a shuttle resting on it. To that end the rack 57 is mounted independently of the length of track 55 on hydraulic actuators 59. This facilitates manual movement of a shuttle on the carrier when in its standby position, as may be desired then to facilitate manual movement of a shuttle from one carrier part to the other.

For preference, a spacer 60, being a length of the T-sectioned track similar to that of the carrier 54, but with continuous conductor rails, is also provided for insertion between the ends of the upper limbs 14 of the main track, so as to maintain the endless nature of the extended track.

The carrier 54 may be mounted on a transporter truck 61 able to be driven to and fro on carrier rails 62 by an under floor linear actuator 63 (preferably a so called rodless cylinder) for movement from a standby position clear of the exclusion zone to a loading position where it is within the exclusion zone but clear of the workpiece support and any article likely to be on it.

When in the loading position the carrier 54 is aligned with the shuttle track 12 when in its off-line position, is parallel to the lower track limbs 15 and at an altitude within the range of altitudes available to those limbs.

Figure 6:
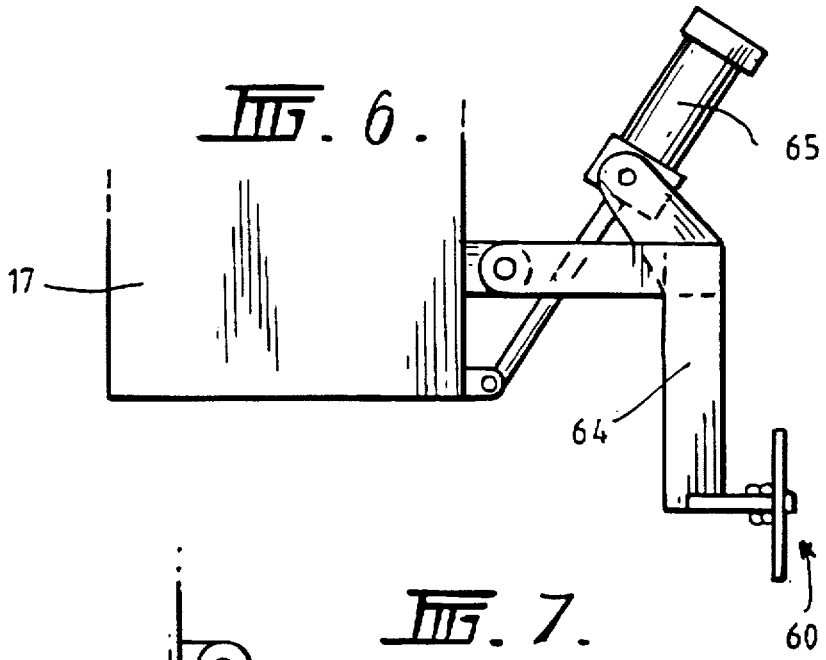
FIG. 6 is a sectional view taken on line 6—6 of FIG. 2 showing a spacer and its support means in the stand-by position drawn to a larger scale.
Figure 7:
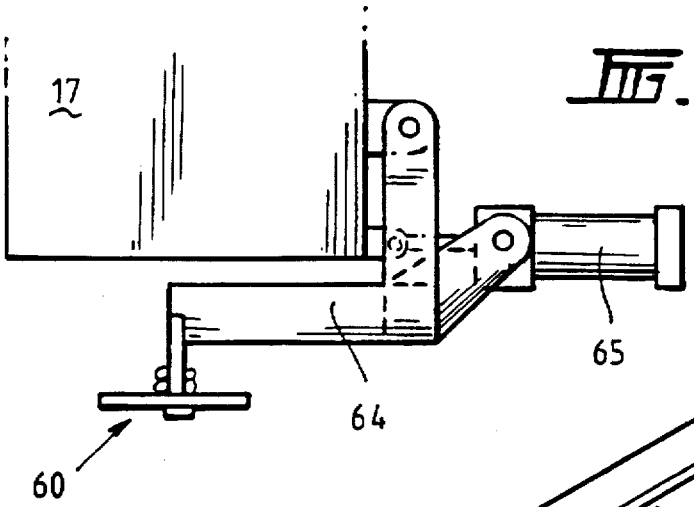
FIG. 7 is a view similar to FIG. 6 showing the spacer and its support means in the operative position.
Figure 8:
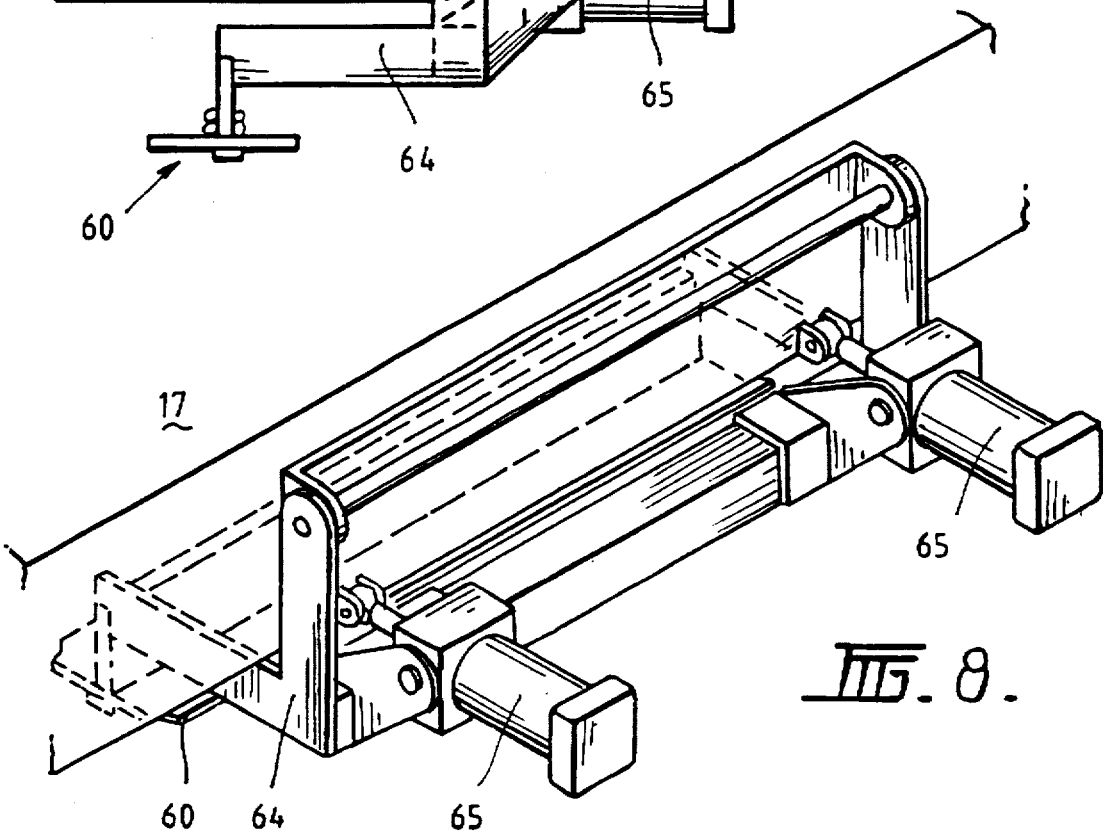
FIG. 8 is a perspective view of the spacer and spacer support means appearing in FIGS. 6 and 7.
Figure 9:
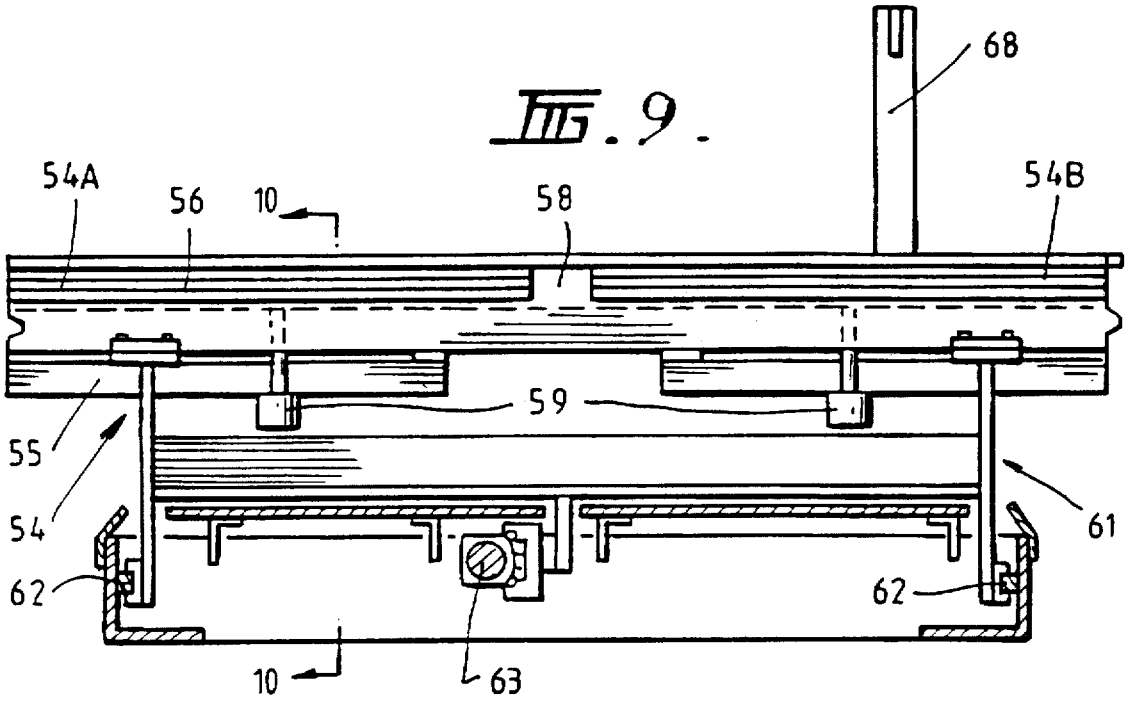
FIG. 9 is a sectional view taken on line 9—9 of FIG. 1, showing a shuttle carrier drawn to a larger scale.
Figure 10:
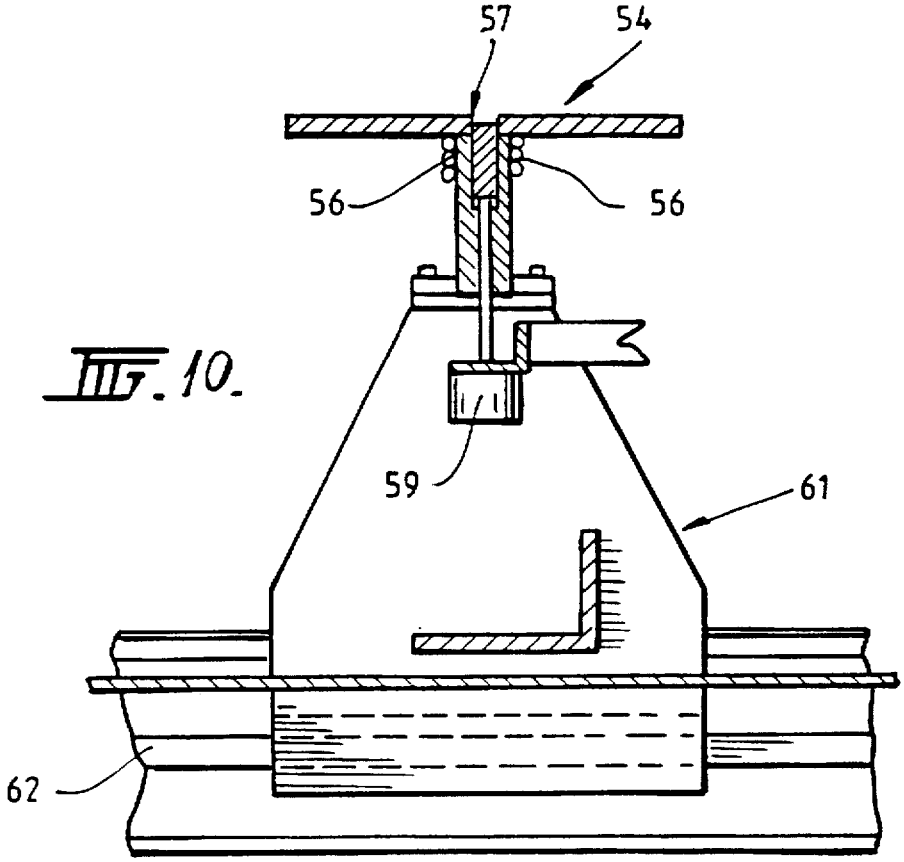
FIG. 10 is a sectional view taken on line 10—10 of FIG. 9.
Figure 11:
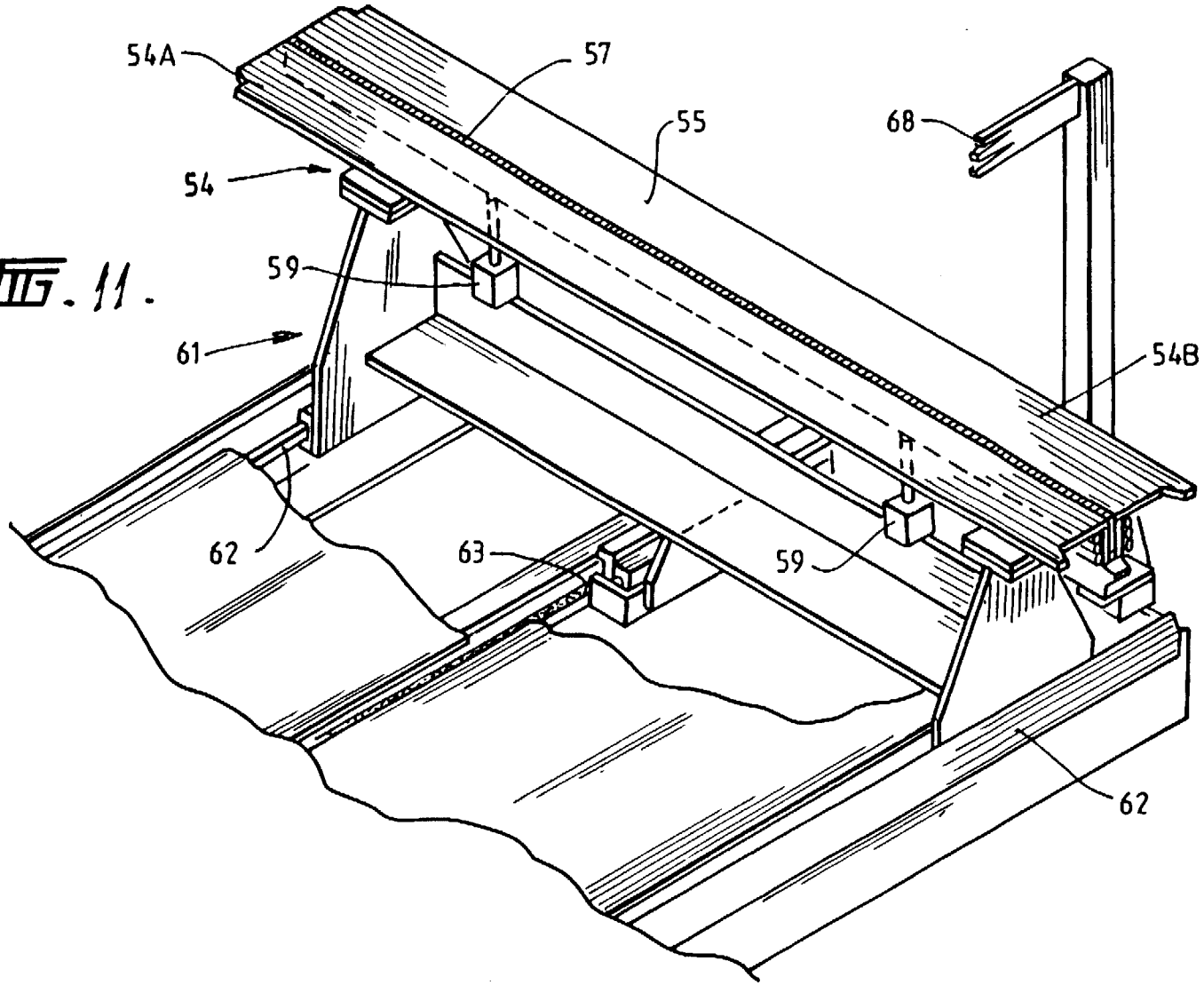
FIG. 11 is a perspective view of the shuttle carrier appearing in FIGS. 9 and 10.

The spacer 60 may be mounted on a swinging bracket 64 hinged to one side of the overhead beam 17. That bracket may be swung, by one or more linear actuators 65 pivoted at one end to the beam 17 and at the other end to the bracket 64, from a standby position (as seen in FIG. 6) where the spacer 60 is clear of the upper flight of the track 12 to a loading position (as seen in FIGS. 7 and 8) where the spacer 60 is in alignment with, and positioned between, the upper limbs 14 of the main track. It is, of course, essential that the gap between the two track parts is fully open to enable the spacer 60 to enter its loading position.

The control means governing the operation of the illustrated embodiment of the invention, and that operation itself, may now be described.

The reasons for which a film dispensing shuttle 13 may need to be changed can vary, but predominantly a change will be required for one or another of the following main reasons:

(a) the operator has detected a minor fault or suspects same within a shuttle and wishes to take the shuttle out of service for inspection and/or repair, (b) the routine maintenance of a shuttle is due and that shuttle may be removed to carry out such maintenance, (c) the shuttle is spent, that is to say, the roll of wrapping medium onboard the shuttle has run out and therefore the apparatus has to be reloaded, which, in accordance with the invention, is effected by replacing the spent shuttle with one which is already primed with a new roll of wrapping medium, or (d) the web of wrapping medium has broken or become detached during a wrapping cycle (generally referred to as a "tear-off") and it may be simpler to perform a shuttle change and then re-commence the cycle rather than to rectify the tear-off problem and manually "re-thread" the web through the partly spent shuttle.

Whatever reasons determine the need for a shuttle change to be initiated, such a change may be ordered either by way of the operator using the machine control panel in the cases of a, b, c & d, or fully automatically in the cases of c & d.

In those latter cases, automatic initiation of a shuttle change may be triggered by a status sensor responsive to loss of tension in the web for any reason (including apparent loss of tension due to absence of the web). The status sensor may generate a signal for transmission to the PLC, or it may be a passive unit adapted to be monitored or interrogated by the PLC, such that the PLC may initiate a shuttle change on detecting a change in the state or condition of the sensor.

In the present instance the shuttle 13 includes accumulator means to hold a varying length of tensioned web to accommodate variations in the rate at which the web is drawn from the shuttle. Those accumulator means include rolls 66 which move to and fro to take up or let out the web, and it is convenient to utilise that movement to determine the presence or absence of tensioned web. If the accumulator parts rest in the "web accumulated" position for any length of time greater than the duration which may be normally attained during the wrapping process, then it may be deduced that the web has broken or that the roll of wrapping medium is exhausted.

Thus, the status sensor may be a switch mounted strategically upon the shuttle so that when the moving accumulator components are positioned in the "web accumulated" position, then the switch is caused to be activated. Though many conventional types of switching device could be utilised, the preferred switch is a mechanically activated electrical limit switch or micro switch with normally open electrical contacts. When the moving accumulator components are resting in the "web accumulated position" the electrical switch contacts are closed, thereby completing an electrical circuit which, in turn, provides an input to the PLC.

The status sensor switch may be connected to the PLC via a dedicated one of the conductor rails 50 and an associated wiper contact 49.

However, the provision of conductor rails around the track additional to those providing power to the shuttle motor, is inconvenient, and a more preferred method of transferring the switching signal from the shuttle to the PLC is by way of a radio link. Thus, a miniature radio frequency transmitter controlled by the sensor switch, and capable of transmitting a signal to a receiver located in close proximity to the moving shuttle, may replace a "hard-wired" electrical link. The same switch arrangement as previously described may still be utilised on the shuttle, however when the contacts of the switch are closed, the miniature transmitter is energised and in turn transmits a radio frequency signal to the receiver for a duration which corresponds with the length of time for which the switch contacts are closed. The receiver, which is wired to the PLC, subsequently provides a relay output signal which corresponds to the switching duration's occurring on board the shuttle. These signals are conditioned and monitored by the PLC, and if the duration of the signal exceeds that which is normal for the wrapping cycle, then this will be detected and the PLC will either initiate a shuttle change procedure, or raise the appropriate alarm, or initiate any desired string of procedures as programmed into the PLC.

In other embodiments similar signalling and control arrangements may be used wherein the signal is transmitted by devices using radiations other than radio frequency electro-magnetic radiation, for example infra-red, ultrasonic, laser or other light energy.

On detecting that a web tear off or run out has occurred, the PLC may cause a display change on an operator's video monitor to notify the operator of an alarm situation. Simultaneously a "shuttle return to park" procedure is initiated which interrupts the wrapping cycle, slows the shuttle travel to "jog" speed, and drives it to a predetermined park position on the track prior to stopping. Arrival of the shuttle at the park position may be indicated to the PLC by a proximity sensor 67 adjacent the track at that position.

The aforesaid "jog" speed may be determined by reducing the frequency of the power supply to the shuttle motor 48.

The video display alarm may be accompanied by an audible alarm if preferred. The video monitor is caused to display an alarm message, which advises the operator that a film tear off or run-out has occurred, and also preferably offers a two choice menu from which the operator may select. Those choices are (a) "Continue Wrapping Cycle", which will allow the operator to manually correct the problem which has occurred onboard the shuttle and then re-commence wrapping, if this option is selected, or (b) "Initiate Shuttle Change", which will commence an automatic shuttle change sequence if selected by the operator.

Alternatively, the control means could be programmed to initiate a shuttle change forthwith, that is without need of a decision or choice from the operator.

Be that as it may, when the PLC initiates a shuttle change it issues commands which cause the following sequence of events to occur:

the spent, or partly spent, shuttle 13 to be replaced is driven to, and halted in, the park position, the cylinders 20 are then activated to cause the track structure parts 16A and 16B to move to the track open position, thereby creating gaps in the upper and lower flights of the track 12, and withdrawing the lower track limbs 15 clear of the article 43 being wrapped, the girder 24 is then traversed laterally to the off-line position wherein the track structure is situated to one side of and spaced from the workpiece support rollers 40, the overhead beam 17 is then raised or lowered to bring the track limbs to a predetermined loading altitude, the linear actuator 63 is then activated to bring the carrier transporter truck 61 and the carrier 54, with a previously loaded shuttle on a front end portion thereof, from its standby to its loading position between, and in alignment with, the lower track limbs 15, the spacer bracket linear actuators 65 are activated to bring the spacer 60 from its standby to its loading position, between and in line with the upper track limbs 14, the cylinders 20 are again activated to bring the track parts together to the extent that they abut the carrier and spacer to form an extended endless track, the track conductor rails 50 and those of the back end portion of the carrier 54 are energised so that the spent or partly spent shuttle is caused to travel at jog speed until it is positioned on the vacant back end portion of the carrier 54, where it is halted, the track conductor rails 50 and those of the front end portion of the carrier 54 are then energised to cause a loaded shuttle positioned on the front end portion of the carrier, to travel at jog speed until it reaches the park position on the track, and then halt, that movement of the loaded shuttle causes a web of wrapping material to be drawn from it (the free end of the roll having been previously secured to a web holder 68 on the transporter truck 61 when the shuttle was loaded therewith) and the web holder 53 intercepts that web takes hold of same and its cutter is activated (as it is at the end of a normal wrapping operation) so as to sever the web between the loaded shuttle and the carrier while maintaining a hold onto the end of the web extending from the shuttle, the cylinders 20 are then re-activated to take the track structure parts in to the track open position, the carrier transporter truck 61 and spacer bracket 64 are returned to their standby positions, the motor 34 is energised to bring the girder 24 to the on-line position, cylinder 32 is actuated to bring the track parts to the correct wrapping altitude, the cylinders 20 are activated to bring the track parts together to close the gaps therebetween, with the lower limbs 15 then extending through the bore of the article 43 being wrapped, and the wrapping cycle is re-commenced.

Finally the operator may reload the spent shuttle with a fresh roll of wrapping medium and move it to the front end portion of the carrier in readiness for the next shuttle replacement operation.

I claim:

1. A wrapping apparatus comprising:

a multi-part endless track surrounding a wrapping station;

a first shuttle and a second shuttle each adapted to have on board a supply of wrapping medium and each including means for dispensing said wrapping medium; each said shuttle being able to ride around the track and thereby wrap an article at said station;

a track support structure including separation means for moving at least one part of the track relative to another part to open and close at least one gap between said parts;

a shuttle carrier means for spanning said at least one gap, at least when said at least one gap is less than fully open, to thereby span said at least one gap as a continuation of the track thereacross;

shuttle carrier support means for inserting and removing said carrier into and from said at least one gap; and control means for controlling movement of the track support structure, shuttle carrier and carrier support means; said first shuttle when located on said track being exchangeable for said second shuttle when located on said shuttle carrier and vice versa by operation of said control means.

2. Wrapping apparatus according to claim 1 wherein the separation means of the track support structure is operable to open and close a second gap, said wrapping apparatus further comprising a spacer adapted to span said second gap at least when said second gap is less than fully open, said spacer spanning said second gap as a continuation of the track and spacer support means for inserting and removing said spacer from said second gap.

3. Wrapping apparatus according to claim 1 wherein each shuttle is electrically driven and is movable under the control of said control means.

4. Wrapping apparatus according to claim 1 further comprising lateral traversing means for shifting said track support structure and the track between an on-line position wherein the track coincides with the wrapping station and an off-line position spaced laterally to one side of said wrapping station.

5. Wrapping apparatus according to claim 4 wherein said lateral traversing means comprises a travelling bridge from which said track support structure is suspended.

6. Wrapping apparatus according to claim 5 wherein said lateral traversing means is operable under the control of said control means.

7. Wrapping apparatus according to claim 1 further comprising elevator means for raising and lowering said track support structure and the track relative to said wrapping station.

8. Wrapping apparatus according to claim 7 wherein said elevator means is operable under the control of said control means.

9. Wrapping apparatus according to claim 8 wherein said control means includes a distance measuring transceiver to monitor the height of an incoming article to be wrapped as it is carried into said wrapping station.

10. Wrapping apparatus according to claim 1 wherein said carrier support means comprises a carriage, guide rails for said carriage and means for moving said carriage along said rails.

11. Wrapping apparatus according to claim 10 wherein said means to move said carriage comprises a linear actuator.

12. Wrapping apparatus according to claim 10 wherein said means for moving said carriage is operable under the control of said control means.

13. Wrapping apparatus according to claim 2 wherein said spacer support means is operable under the control of said control means.

14. Wrapping apparatus according to claim 1 further comprising load support means for the rotational support of a cylindrical article in said wrapping station.

15. Wrapping apparatus according to claim 14 further comprising a conveyor for the transport of an article to be wrapped through the apparatus and wherein the load support means includes jacking means for lifting the article from said conveyor into the wrapping station and thereafter lowering the wrapped article onto the conveyor.

16. Wrapping apparatus according to claim 15 wherein said jacking means is operable under the control of said control means.

17. Wrapping apparatus comprising a two part endless track surrounding a wrapping station, first and second electrically driven shuttles for dispensing wrapping medium, said shuttles being able to ride around the track and thereby wrap an article in said station, a track support structure including separation means for moving at least one part of the track relative to another part to open and close first and second gaps between the parts of said track, a shuttle carrier incorporating means for spanning said first gap as a continuation of the track thereacross, shuttle carrier support means for inserting and removing said carrier into said first gap, a spacer adapted to span said second gap at least when said second gap is less than fully open, spacer support means for inserting and removing said spacer from said second gap, lateral traversing means for shifting said track support structure and the track between an on-line position wherein the track coincides with the wrapping station and an off-line position spaced laterally to one side of said wrapping station, elevator means for raising and lowering said track support structure and the track relative to said wrapping station, load support means for the rotational support of a cylindrical article in said wrapping station, a conveyor for the transport of an article to be wrapped through the apparatus, jacking means for lifting the article from the conveyor into the wrapping station and thereafter lower the wrapped article onto the conveyor, and programmable control means for controlling the movement of said wrapping apparatus to exchange said first shuttle when located on said track for said second shuttle when located on said shuttle carrier, said first shuttle being driven from the track onto the carrier and said second shuttle being driven from the carrier onto the track when said shuttle carrier and said spacer are spanning the first and second gaps respectively.

18. A method of reloading a wrapping apparatus of the kind comprising an endless track having a plurality of parts and a shuttle for dispensing wrapping medium and able to ride around said track, comprising the steps of providing a loaded shuttle on a shuttle carrier, moving at least one part of said track to open a gap in said track, inserting a shuttle carrier into said gap to close said gap with said shuttle carrier, moving a spent or partly spent shuttle from said track onto said shuttle carrier, moving said loaded shuttle from said carrier onto said track, removing said shuttle carrier from said gap, and closing said gap.

19. A wrapping apparatus comprising a multi-part endless track surrounding a wrapping station;

a first shuttle and a second shuttle each adapted to have on board a supply of wrapping medium and each including means for dispensing said wrapping medium, each said shuttle being able to ride around the track and thereby wrap an article at said station;

a track support structure including separation means for moving at least one part of the track to another to open and close two gaps between those parts;

a shuttle carrier including means for spanning a first gap at least when said first gap is less than fully open to thereby span said first gap as a continuation of the track thereacross;

a shuttle carrier support means including means for inserting and removing said carrier into and from said first gap;

a spacer adapted to span said second gap at least when said second gap is less than fully open, said spacer spanning said second gap as a continuation of the track;

spacer support including means for inserting and removing said spacer into and from said second gap; and control means controlling movement of the track support structure, shuttle carrier, carrier support means, spacer and spacer support; said first shuttle located on said track being exchangeable for said second shuttle when located on said shuttle carrier and vice versa by operation of said control means.

20. The wrapping apparatus according to claim 19 wherein said spacer support is operable under the control of said control means.

* * * * *